US007398567B2

(12) United States Patent
Leng

(10) Patent No.: US 7,398,567 B2
(45) Date of Patent: Jul. 15, 2008

(54) STEELWIRE-HOOK MODE WEB SHEET

(76) Inventor: Luhao Leng, No. 139 Fanghu West Road, Xiamen, Fujian Province (CN) 361000

( * ) Notice: Subject to any disclaimer, the term of this patent is extended or adjusted under 35 U.S.C. 154(b) by 311 days.

(21) Appl. No.: 10/522,656

(22) PCT Filed: Mar. 25, 2004

(86) PCT No.: PCT/CN2004/000251

§ 371 (c)(1),
(2), (4) Date: Jan. 24, 2005

(87) PCT Pub. No.: WO2004/084678

PCT Pub. Date: Oct. 7, 2004

(65) Prior Publication Data

US 2006/0016936 A1 Jan. 26, 2006

(30) Foreign Application Priority Data

Mar. 25, 2003 (CN) ..... 03 2 16835

(51) Int. Cl.
*A47C 23/14* (2006.01)
*F16F 3/00* (2006.01)

(52) U.S. Cl. ..... 5/186.1; 5/190; 5/247; 5/260; 267/110

(58) Field of Classification Search ..... 5/186.1, 5/188–190, 247, 260, 13, 400; 267/110–112; 297/452.52, 452.63, 452.64
See application file for complete search history.

(56) References Cited

U.S. PATENT DOCUMENTS 802,415 A * 10/1905 Sleight ..... 5/190
1,045,856 A * 12/1912 Klipfel et al. ..... 245/11
1,506,416 A * 8/1924 Dewey ..... 5/29
2,044,336 A * 6/1936 Schwartzman ..... 245/5
2,244,469 A * 6/1941 Menge ..... 267/111
2,260,352 A * 10/1941 Trapani ..... 297/255
2,294,534 A * 9/1942 Berger ..... 5/189
2,332,041 A * 10/1943 Asaro ..... 267/88
2,371,407 A * 3/1945 Neely ..... 5/409
2,440,001 A * 4/1948 Blumensaadt ..... 267/107
2,469,216 A * 5/1949 Spunt et al. ..... 5/246

(Continued)

*Primary Examiner*—Robert G. Santos
(74) *Attorney, Agent, or Firm*—Greer, Burns & Crain, Ltd.

(57) ABSTRACT

A hook-ended steel wire netting includes a first cross rail having a row of first sockets on its outer portion in a line along an axial direction; a second cross rail having a row of second sockets on its outer portion in a line along an axial direction; one or more longitudinal steel wires, both ends of which are hooks, a first end hook of each steel wire encloses a part of the outer portion of one of the cross rails and is secured by being inserted into one of the first sockets, and a second end hook of each steel wire encloses a part of the outer portion of one of the cross rails and is secured by being inserted into one of the second sockets. A first longitudinal rail has both ends separately secured to the first end of the first cross rail and the first end of the second cross rail; a second longitudinal rail has both ends separately secured to the second end of the first cross rail and the second end of the second cross rail; and wherein the first longitudinal rail and the second longitudinal rail tense the steel wires to form a steel wire netting.

16 Claims, 6 Drawing Sheets

U.S. PATENT DOCUMENTS 2,545,513 A * 3/1951 Emberson ..... 267/112
2,622,661 A * 12/1952 Markle ..... 267/102
2,633,185 A * 3/1953 Emberson ..... 297/452.49
2,657,738 A * 11/1953 Kruszona ..... 267/107
2,669,290 A * 2/1954 Neely ..... 267/107
2,727,250 A * 12/1955 Fox ..... 5/13
2,742,653 A * 4/1956 Woller ..... 5/226
2,870,823 A * 1/1959 Staples ..... 267/110
3,035,828 A * 5/1962 Stubnitz ..... 267/110
3,117,774 A * 1/1964 Isaacs ..... 267/80
3,275,357 A * 9/1966 Tabor ..... 403/208
3,308,487 A * 3/1967 Birgbauer, Jr. ..... 5/260
3,386,725 A * 6/1968 Fujikawa ..... 267/110
3,462,196 A * 8/1969 Arnold et al. ..... 297/452.49
3,487,481 A * 1/1970 Platt et al. ..... 267/86
3,559,219 A * 2/1971 Molt ..... 5/247
3,608,105 A * 9/1971 Flatford ..... 5/232
3,628,780 A * 12/1971 Saito ..... 267/110
3,720,568 A * 3/1973 Rowland ..... 267/111
3,733,625 A * 5/1973 Platt et al. ..... 5/188
3,767,261 A * 10/1973 Rowland ..... 297/452.64
3,797,886 A * 3/1974 Griffiths ..... 297/452.23
3,841,618 A * 10/1974 Solomons ..... 267/110
3,880,413 A * 4/1975 Platt et al. ..... 267/80
3,888,474 A * 6/1975 Mandusky et al. ..... 267/110
3,971,082 A * 7/1976 Crosby et al. ..... 5/260
4,055,865 A * 11/1977 Crosby et al. ..... 5/259.1
4,070,124 A * 1/1978 Crosby et al. ..... 403/208
4,120,059 A * 10/1978 Cavaler ..... 5/256
4,136,410 A * 1/1979 Vandenbark et al. ..... 5/190
4,147,336 A * 4/1979 Yamawaki et al. ..... 267/111
4,191,424 A * 3/1980 Mundell ..... 297/452.26
4,228,991 A * 10/1980 Crosby ..... 267/110
4,289,304 A * 9/1981 Muzzell ..... 267/112
4,337,931 A * 7/1982 Mundell et al. ..... 267/102
4,754,505 A * 7/1988 Mizelle ..... 5/13
5,074,534 A * 12/1991 Hoshino ..... 267/144
5,231,709 A * 8/1993 Miller ..... 5/13
5,305,479 A * 4/1994 Robinson ..... 5/13
5,588,163 A * 12/1996 Miller ..... 5/13
5,745,935 A * 5/1998 Arft ..... 5/13
2006/0016936 A1 * 1/2006 Leng ..... 245/2

* cited by examiner

A-A

STEELWIRE-HOOK MODE WEB SHEET

FIELD OF THE INVENTION

The present invention generally relates to steel wire nettings in steel furniture and, in particular, to the structure of the connection between steel wires and a frame.

BACKGROUND TECHNOLOGY

Steel furniture is appreciated because of its easy assembly, modern types etc., particularly furniture which combines steel with fabric, such as sofas, folding sofa beds, steel camp beds, etc. The steel wire netting on conventional steel furniture, e.g., the net mattress of a camp bed, is made of a steel wire netting with a frame. The steel wires are connected to the frame using dot welding. However, this leads to disadvantages that the steel wire netting may easily distend and deform, and it is difficult to maintain the tension in the netting.

In order to enable a camp bed to maintain tension in the netting, patent No CN 97238776 describes a composite steel wire camp bed in which the steel wires are tensed by a frame. The frame includes two cross rails and four longitudinal rails. Longitudinal rails are secured to each other by connection shafts and cross rails are secured to longitudinal rails by right connection braces at the four corners where longitudinal rails and cross rails intersect. Camp beds of this type can maintain tension in the wire netting, and flexible bearings can be installed underneath, which allows users to lie in comfort and prevents the surface of the bed from distending downwards. However, this structure includes too many components and the connection structure is complex. In addition, the production process is complex, which increases the cost. Therefore, it is difficult to use the above structure widely in sofas, sofa beds and the like.

BRIEF SUMMARY OF THE INVENTION

The purpose of the present invention is to create a hook-ended steel wire netting which is firm, reliable, flexible, comfortable, and has a simple structure.

In order to realize these aims, the solution presented in this invention is: a netting of hook-ended steel wires, which may comprise:

- A first cross rail having a row of first sockets on its outer portion in a line along the axial direction.
- A second cross rail having a row of second sockets on its outer portion in a line along the axial direction.
- One or more longitudinal steel wires, both ends of which are hooks. The first end hook of each steel wire encloses a part of the outer portion of the first cross rail, and is secured by being inserted into one of the first sockets. The second end hook of each steel wire encloses a part of the outer portion of the second cross rail, and is secured by being inserted into one of the second sockets.
- A first longitudinal rail with both ends separately secured to the first end of the first cross rail and the first end of the second cross rail.
- A second longitudinal rail with both ends separately secured to the second end of the first cross rail and the second end of the second cross rail.

Meanwhile, the first longitudinal rail and the second longitudinal rail tense the steel wires to form a steel wire netting.

The cross-sections of the described first and second cross rails are circular, square or of another suitable shape.

The described first sockets are disposed on the outer portion of the first cross rail; the described second sockets are disposed on the outer portion of the second cross rail.

The end hooks of the described longitudinal steel wires are formed by curving the end portions of steel wires through 180 degrees. The shape of the curved portion between the hook and the straight portion of the steel wire may match the shape of the outer portion of the cross rails.

The cross-sections of the first and second longitudinal rails are circular, square or of another suitable shape.

The described first cross rail may be an L-shaped rail, of which the shorter portion is regarded as the first longitudinal rail. The described second cross rail may be an L-shaped rail, of which the shorter portion is regarded as the second longitudinal rail. The two L-shaped rails are connected to form a frame.

The described first cross rail may be a U-shaped rail, of which the two parallel portions are regarded as the first longitudinal rail and the second longitudinal rail. The described second cross rail is a straight rail and is secured to the two ends of the U-shaped rail to form a frame.

A hook-ended steel wire netting may comprise:

- A first cross rail having a row of first sockets on its outer portion in a line along the axial direction.
- A second cross rail having a row of second sockets on its outer portion in a line along the axial direction.
- One or more longitudinal steel wires, both ends of which are hooks. The first end hook of each steel wire encloses a part of the outer portion of the first cross rail, and is secured by being inserted into one of the first sockets. The second end hook of each steel wire encloses a part of the outer portion of the second cross rail, and is secured by being inserted into one of the second sockets.
- A first longitudinal rail having a row of third sockets on its outer portion in a line along the axial direction.
- A second longitudinal rail having a row of fourth sockets on its outer portion in a line along the axial direction.
- One or more cross steel wires, both ends of which are hooks. The first end hook of each steel wire encloses a part of the outer portion of the first longitudinal rail, and is secured by being inserted into one of the third sockets. The second end hook of each steel wire encloses a part of the outer portion of the second longitudinal rail, and is secured by being inserted into one of the fourth sockets.
- The two ends of the first longitudinal rail are separately secured to the first end of the first cross rail and first end of the second cross rail. The two ends of the second longitudinal rail are separately secured to the second end of the first cross rail and second end of the second cross rail. Meanwhile, the first longitudinal rail and the second longitudinal rail tense the steel wires to form a steel wire netting.

The described cross and longitudinal steel wires are connected or partly connected to each other at the points where they intersect to form a net.

To form the above structure, the end hooks of one or more longitudinal steel wires are first inserted into sockets of two cross rails, then longitudinal rails are used to tense the steel wires; the longitudinal rails are securely connected to the cross rails to form a frame. In order to increase the strength of the netting and to reduce the length of the cross steel wires, one or more longitudinal rails may be added into the frame; then the end hooks of one or more cross steel wires are inserted into opposing sockets of two longitudinal rails, and the cross and longitudinal steel wires are securely connected to each other at the points where they intersect to form a net.

In the present structure, the steel wires and the cross and longitudinal rails are connected with bayonet connections, not by welding. Compared to existing technology, the present invention requires fewer components, its connections have a simpler structure, the netting is more durable and can be constructed using less welding. In addition, the netting has a high elasticity, which increases the comfort of the user. This netting may be used to manufacture camp beds, sofa seats and backs, etc.

BRIEF DESCRIPTION OF THE DRAWINGS

The present invention will be described with greater specificity and detail through the use of the accompanying drawings, in which.

DETAILED DESCRIPTION OF THE PREFERRED EMBODIMENTS

Figure 1:
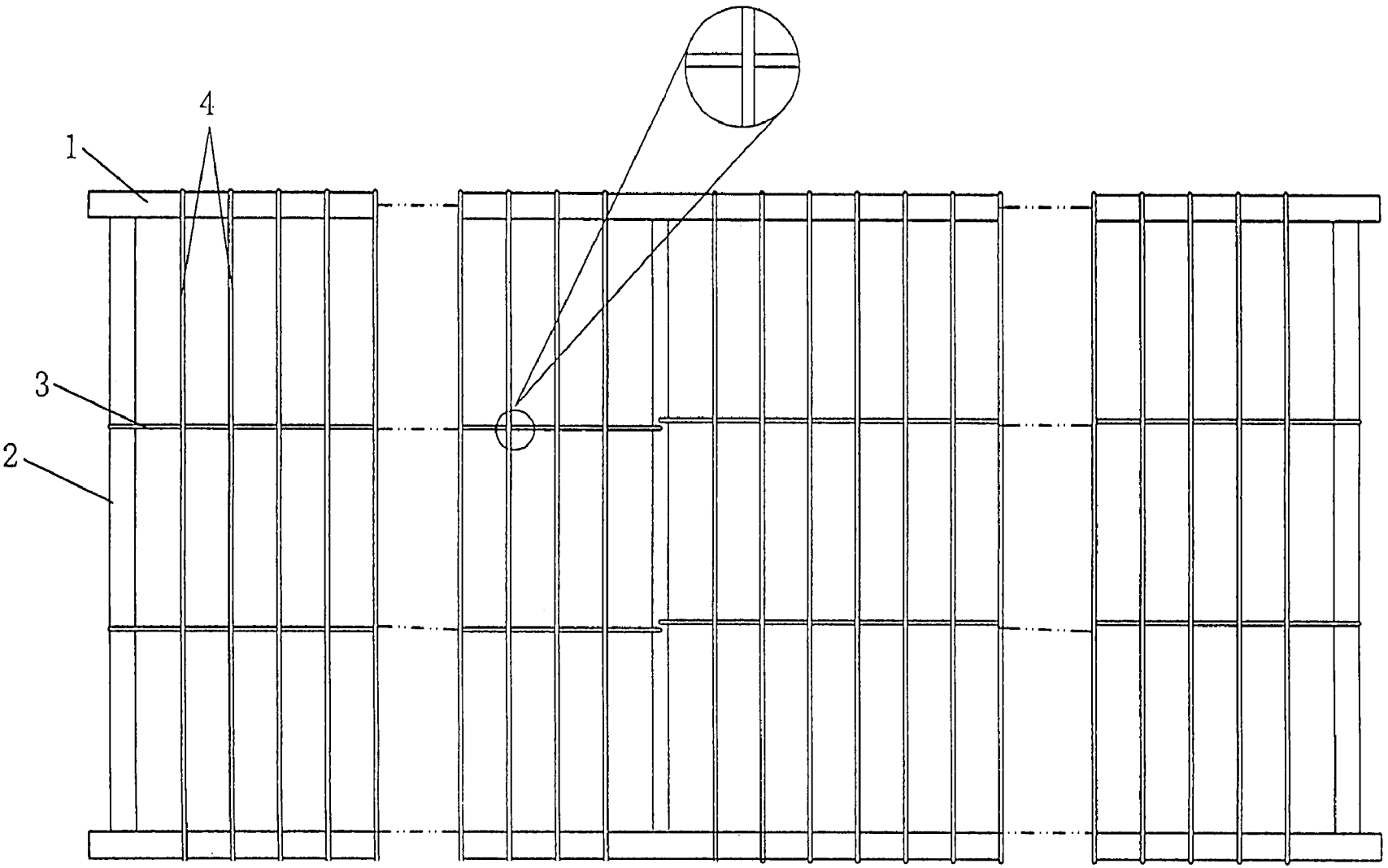
FIG. 1 is a front view of a first embodiment of the present invention.

With reference to the embodiment of a hook-ended steel wire netting shown in FIG. 1, a hook-ended steel wire netting includes: two cross rails 1; two longitudinal rails 2; one or more cross steel wires 3 with end hooks 31; one or more longitudinal steel wires 4 with end hooks 41. Two rows of sockets 11 are disposed on a cross rail 1 and a longitudinal rail 2. Both ends of one or more longitudinal steel wires enclose the outer portion or outer sidewall 12 of the cross rails, and are free of contact with an inner sidewall 14 (FIG. 3) and the end hooks are inserted into the opposing sockets. Two longitudinal rails 2 tense the longitudinal steel wires 4 and are secured to the ends of the cross rails 1. One or more cross steel wires 3 with end hooks inserted into opposing sockets 21 of the longitudinal rails 2 are disposed underneath the longitudinal steel wires. The cross 3 and longitudinal 4 steel wires are dot welded at the points where they intersect to form a steel wires netting, with the longitudinal rails 2 and the cross rails 1 forming a frame. To further increase the strength of the netting and to reduce the length of the steel wires, one or more longitudinal rails 2 connected to cross rails 1 may be added.

Figure 2:
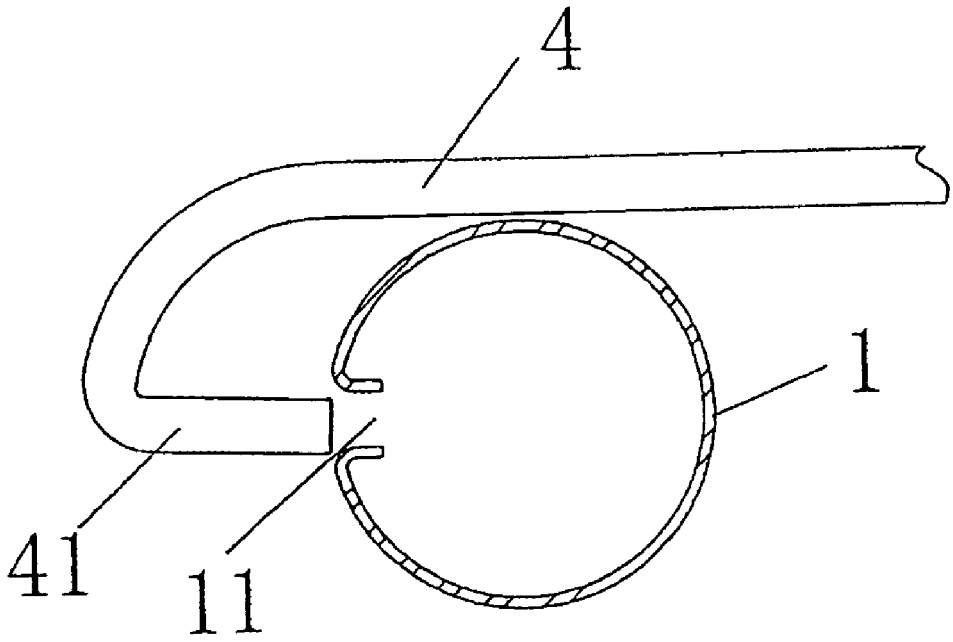
FIG. 2 is a explicatory drawing of the embodiment shown in FIG. 1, illustrating the connection of the longitudinal steel wires to the cross rails.

With reference to FIG. 2, the cross rails 1 both have circular cross-sections, which can increase tensile strength of the cross rails 1 in use. The end hooks 41 on the longitudinal steel wires 4 are formed by curving the end portions of the steel wires through 180 degrees, and the curved portion between the hook 41 and the straight portion of each wire encloses some of the outer portion of the cross-rails 1.

Figure 3:
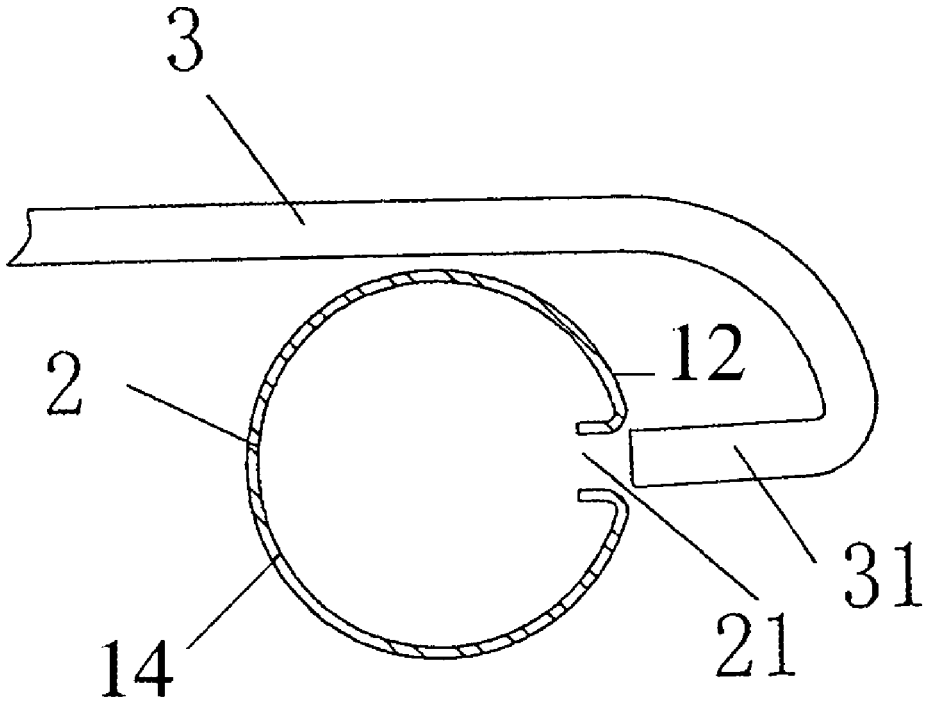
FIG. 3 is a explicatory drawing of the embodiment shown in FIG. 1, illustrating the connection of the cross steel wires to the longitudinal rails.

With reference to FIG. 3, the longitudinal rails 2 both have circular cross-sections, which can increase the tensile strength of the longitudinal rails 2 in use. The end hooks 31 on the cross steel wires 3 are formed by curving the end portions of the steel wires through 180 degrees, and the curved portion between the hook 31 and the straight portion of each wire encloses some of the outer portion of the cross-rails 1.

In the above structure, both end hooks of one or more longitudinal steel wires 4 are first inserted into opposing sockets 11 of the two cross rails, then longitudinal rails 2 are used to tense the steel wires 4 and the longitudinal rails 2 are securely connected to the cross rails 1 to form a frame. Then both end hooks of one or more cross steel wires 3 are inserted into opposing sockets 21 of the two longitudinal rails 2. The cross and longitudinal steel wires are securely connected to each other at the points where they intersect to form a supportive netting for the surface of the bed. In the present structure, the steel wires and the cross and longitudinal rails are connected with bayonet connections, not by welding. Compared to existing technology, the present invention requires fewer components, its connections have a simpler structure, the netting is more durable and can be constructed using less welding. In addition, the netting has a high elasticity, which increases the comfort of the user.

Figure 4:
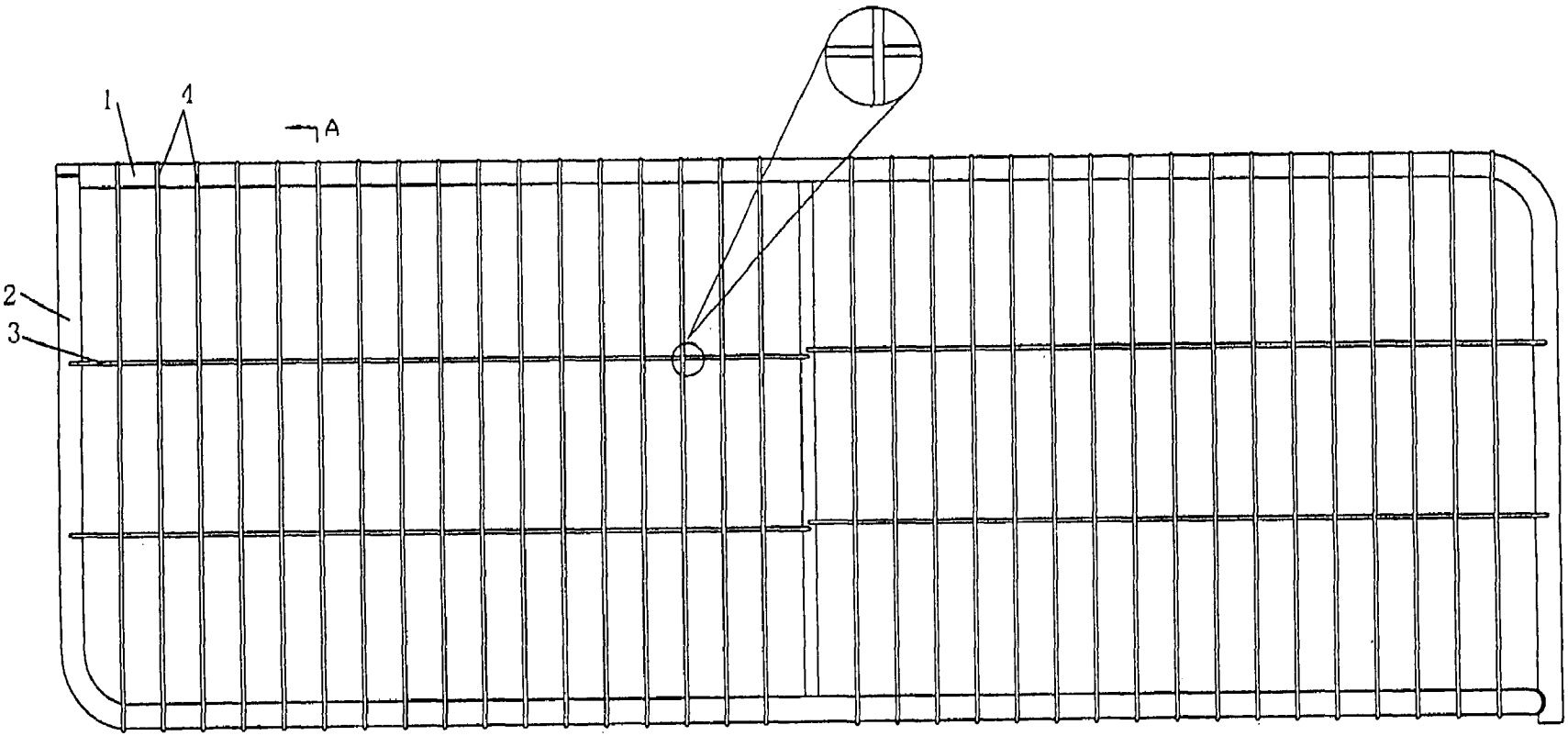
FIG. 4 is a front view of a second embodiment of the present invention.

With reference to the second embodiment shown in FIG. 4, a hook-ended steel wire netting may include two L-shaped rails 1,2 and one or more cross and longitudinal steel wires 3,4 which hooks 31,41 at both ends. The shorter portions of the L-shaped rails can be regarded as longitudinal rails. Sockets 11,21 are disposed on the L-shaped rails. Both end hooks of one or more longitudinal steel wires are separately inserted into opposing sockets 11 on the L-shaped rails. The longitudinal rails tense the steel wires, and the two L-shaped rails are connected to form a frame. One or more cross steel wires, with both hook ends inserted into opposing sockets 21 of the longitudinal rails 2 are disposed underneath the longitudinal steel wires 4. The cross 3 and longitudinal 4 steel wires are dot welded at the places where they intersect to form a steel wire netting surface, with the L-shaped rails forming a frame. To further increase the strength of the netting and to reduce the length of the steel wires, one or more longitudinal rails 2 connected to the cross rails 1 may be added.

Figure 5:
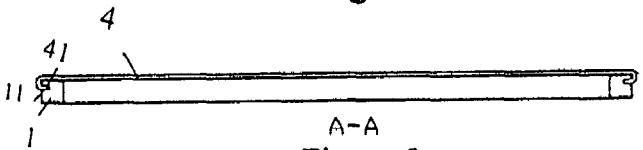
FIG. 5 is a cross-sectional view of the embodiment shown in FIG. 4, viewed from the line A-A.

As shown in FIG. 5, the two cross rails both have square cross-sections, which can increase the tensile strength of the cross rails when in use. The end hooks 41 of the longitudinal steel wires 4 are formed by curving the end portions of the steel wires through 180 degrees, and shape of the curved portion between the hooks 41 and the straight portion of the wire matches the shape of the outer portion of the cross rails 1.

Figure 6:
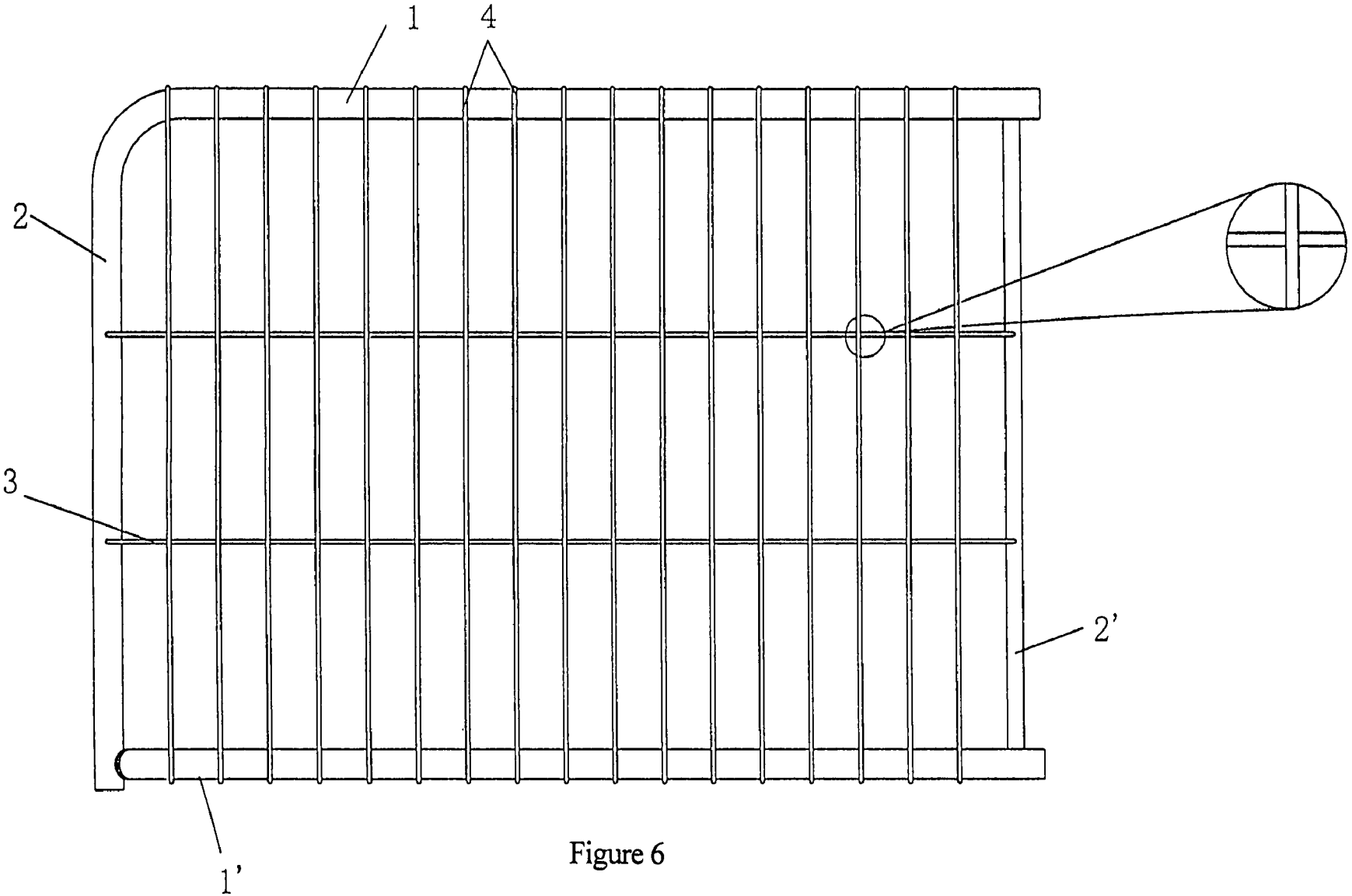
FIG. 6 is a front view of a third embodiment of the present invention.

With reference to the third embodiment shown in FIG. 6, a hook-ended steel wire netting may include one L-shaped cross rail 1, the shorter portion of which is regarded as a longitudinal rail 2, one or more cross steel wires 3, one or more longitudinal steel wires 4, a long straight rail and a short straight rail. The long-straight rail is regarded as a cross rail 1' and the short straight rail is regarded as a longitudinal rail 2'. Sockets are disposed on the cross rails 1,1' and longitudinal rails 2,2'. Both end hooks of one or more longitudinal steel wires 4 are separately inserted into opposing sockets on cross rails 1 and 1', and the longitudinal rails 2,2' are used to tense the steel wires. The cross rails 1,1' and the longitudinal rails 2,2' are head-to-tail connected to form a frame. One or more cross steel wires 3 with end hooks 31 inserted into opposing sockets 21 on the longitudinal rails 2,2' are disposed underneath the longitudinal steel wire 4. The cross 3 and longitudinal 4 steel wire are dot welded at the place where they interlace to form a steel wire netting.

Figure 7:
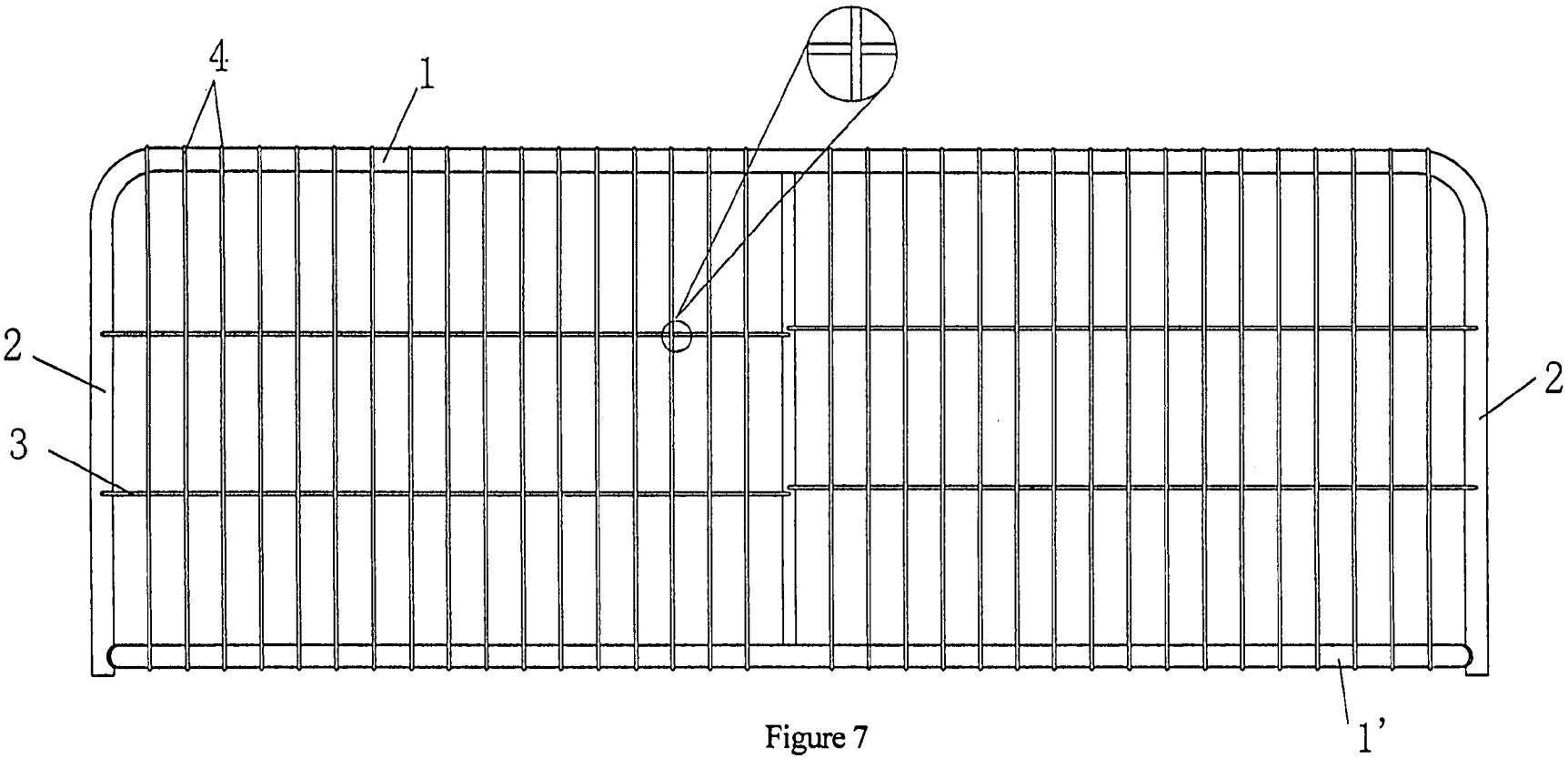
FIG. 7 is a front view of a fourth embodiment of the present invention.

With reference to the fourth embodiment shown in FIG. 7, a hook-ended steel wire netting may include a U-shaped rail, a straight cross rail 1', one or more cross steel wires 3 with end hooks 31, and one or more longitudinal steel wires 4 with end hooks 41. The two parallel portions of the U-shaped rail are regarded as the two longitudinal rails 2, and the middle portion of the U-shaped rail is regarded as the cross rail 1. Sockets are disposed on the cross rail 1,1' and longitudinal rail 2. Both end hooks of one or more longitudinal steel wires 4 are separately inserted into opposing sockets on cross rails 1 and 1', and the longitudinal rails 2 are used to tense the longitudinal steel wires 4. The cross rail 1' is connected to the two ends of the U-shaped rail to form a frame. One or more cross steel wires 3 with end hooks 31 inserted into opposing sockets 21 of the longitudinal rails 2 are disposed underneath the longitudinal steel wires 4. The cross 3 and longitudinal 4 steel wires are dot welded at the places where they intersect to form a steel wire netting. To further increase the strength of the netting and to reduce the length of the steel wire, one or more longitudinal rails 2 connected to cross rails 1 may be added.

Figure 8:
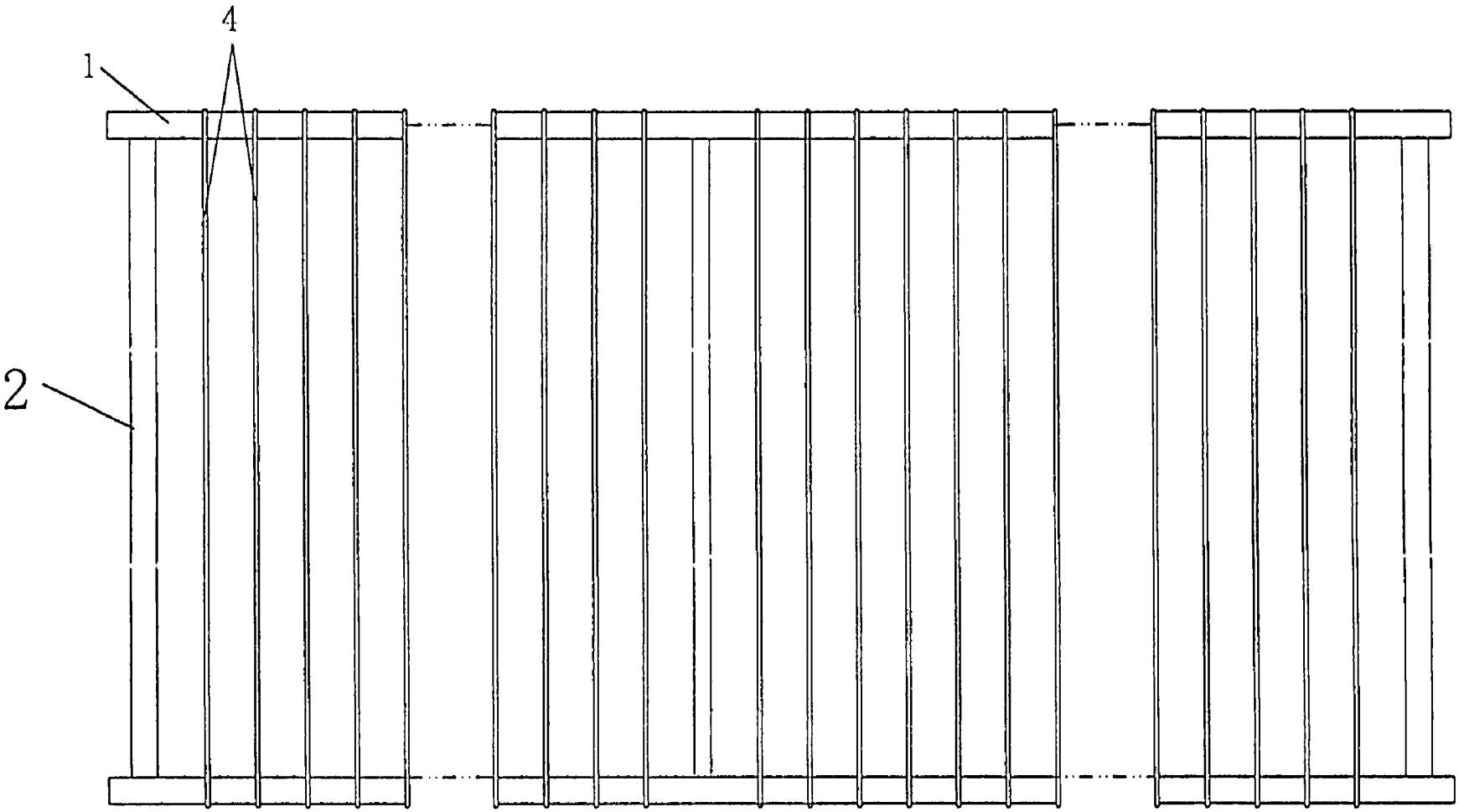
FIG. 8 is a front view of a fifth embodiment of the present invention.

With reference to the fifth embodiment shown in FIG. 8, a hook-ended steel wire netting may include two cross rails 1, two longitudinal rails 2, and one or more longitudinal steel wires 4 with end hooks 41. Sockets are disposed on the cross rails 1 on the outer portions in a line along the axial direction. Both end hooks of one or more longitudinal steel wires 4 are inserted into opposing sockets on the two cross rails 1. The two longitudinal rails 2 tense the steel wires 4 and are securely connected to the cross rails 1 to form a frame.

A hook-ended steel wire netting is provided in the present invention, in which the cross and longitudinal steel wires are connected to the longitudinal and cross rails by end hooks. The netting has a simple structure which is safe, durable and highly practical for industry.

The invention claimed is:

1. A hook-ended steel wire netting comprises:

a first cross rail having a row of first sockets on its outer portion in a line along an axial direction;

a second cross rail having a row of second sockets on its outer portion in a line along an axial direction;

one or more longitudinal steel wires each having two ends and extending in a straight line between said first and second cross rails, both wherein ends of each of said longitudinal steel wires are hooks, a first end hook of each said steel wire encloses a part of the outer portion of one of said cross rails and is secured by being directly inserted into one of the first sockets at the outer portion of said first cross rail, a second end hook of each said steel wire encloses a part of the outer portion of one of said cross rails and is secured by being directly inserted into one of the second sockets at the outer portion of said second rail, said first end hook and said second end hook remaining free of contact with an inner sidewall of said first and second cross rails;

a first longitudinal rail having two ends with both ends separately secured to the first end of the first cross rail and the first end of the second cross rail;

a second longitudinal rail having two ends with both ends separately secured to the second end of the first cross rail and the second end of the second cross rail; and wherein the first longitudinal rail and the second longitudinal rail tense the steel wires to form a steel wire netting.

2. The hook-ended steel wire netting as recited in claim 1, wherein the first and second cross rails have circular, square or other suitable cross-sections.

3. The hook-ended steel wire netting as recited in claim 1, wherein the end hooks of the longitudinal steel wires are formed by curving the end portions of the steel wires through 180 degrees, and the curved portion between the hook and the straight portion of the steel wire matches the shape of the outer portion of the cross rails.

4. The hook-ended steel wire netting as recited in claim 1, wherein the first and second longitudinal rails have circular, square or other suitable cross-sections.

5. The hook-ended steel wire netting as recited in claim 1, wherein the first cross rail is an L-shaped rail, of which the shorter portion is regarded as the first longitudinal rail, and the second cross rail is an L-shaped rail, of which the shorter portion is regarded as the second longitudinal rail, the two L-shaped rails are connected to form a frame.

6. The hook-ended steel wire netting as recited in claim 1, wherein the first cross rail is a U-shaped rail, the two parallel portions of which are regarded as the first longitudinal rail and the second longitudinal rail, and the second cross rail is a straight rail and is secured to the two ends of the U-shaped rail to form a frame.

7. The hook-ended steel wire netting of claim 1 wherein each of said longitudinal steel wires is a unitary, integrally formed wire extending between said first and second cross rails.

8. The hook-ended steel wire netting of claim 1 wherein an axis of each of said first and second sockets is parallel to a longitudinal axis of said longitudinal steel wires.

9. The hook-ended steel wire netting of claim 1 further including one or more cross steel wires, both ends of which are hooks, wherein said first longitudinal rail includes a top portion having a row of third sockets in a line along an axial direction, and said second longitudinal rail includes a top portion having a row of fourth sockets in a line along an axial direction, each of said third and fourth sockets constructed and arranged for receiving a first end hook and a second end hook of one of said cross steel wires, respectively.

10. A hook-ended steel wire netting comprises:

a first cross rail having a row of first sockets on its outer portion in a line along an axial direction;

a second cross rail having a row of second sockets on its outer portion in a line along an axial direction;

one or more longitudinal steel wires each having two ends and extending in a straight line between said first and second cross rails, both wherein ends of each of said longitudinal steel wires are hooks-, a first end hook of each longitudinal steel wire encloses a part of the outer portion of a cross rail, and is secured by being directly inserted into one of the first sockets at the outer portion of the first cross rail, a second end hook of each longitudinal steel wire encloses a part of the outer portion of a cross rail, and is secured by being directly inserted into one of the second sockets at the outer portion of the second cross rail;

a first longitudinal rail having a row of third sockets on its outer portion in a line along an axial direction;

a second longitudinal rail having a row of fourth sockets on its outer portion in a line along an axial direction;

one or more cross steel wires, both ends of which are hooks-, a first end hook of each cross steel wire encloses a part of the outer portion of a longitudinal rail, and is secured by being directly inserted into one of the third sockets at the outer portion of the first longitudinal rail, a second end hook of each cross steel wire encloses a part of the outer portion of a longitudinal rail, and is secured by being directly inserted into one of the fourth sockets at the outer portion of the second longitudinal rail; and two ends of the first longitudinal rail are secured to the first end of the first cross rail and the first end of the second cross rail separately, two ends of the second longitudinal rail are secured to the second end of the first cross rail and the second end of the second cross rail separately;

the first longitudinal rail and the second longitudinal rail tense the steel wires to form a steel wires netting top.

11. The hook-ended steel wire netting as recited in claim 10, wherein the cross and longitudinal steel wires are connected or partly connected to each other at points where they intersect to form a net.

12. The hook-ended steel wire netting as recited in claim 10, wherein the end hooks of the longitudinal steel wires are formed by curving the end portions of steel wires through 180 degrees, and the curved portion between the hook and the straight portion of the steel wire matches the shape of the outer portion of the cross rails.

13. The hook-ended steel wire netting as recited in claim 10, wherein the end hooks of the cross steel wires are formed by curving the end portions of steel wires through 180 degrees, and the curved portion between the hook and the straight portion of the steel wire matches the shape of the outer portion of the longitudinal rails.

14. The hook-ended steel wire netting as recited in claim 10, wherein the first and second longitudinal rails have circular, square or other suitable cross-sections.

15. The hook-ended steel wire netting as recited in claim 10, wherein the first and second cross rails have circular, square or other suitable cross-sections.

16. A hook-ended steel wire netting comprises:

a first cross rail having a row of first sockets on its outer portion in a line along an axial direction;

a second cross rail having a row of second sockets on its outer portion in a line along an axial direction;

one or more longitudinal steel wires, each of said steel wires having two ends and being unitary and integrally formed and extending in a straight line between said first and second cross rails, both ends of each of said longitudinal steel wires being hooks, a first end hook of each said steel wire encloses a part of the outer portion of one of said cross rails and is secured by being directly inserted into one of the first sockets at the outer portion of said first cross rail, a second end hook of each said steel wire encloses a part of the outer portion of one of said cross rails and is secured by being directly inserted into one of the second sockets at the outer portion of said second rail, an axis of each of said first and second sockets being parallel with a longitudinal axis of said longitudinal steel wires, said first end hook and said second end hook remaining free of contact with an inner sidewall of said first and second cross rails;

a first longitudinal rail including a top portion having a row of third sockets in a line along an axial direction, wherein both ends of said first longitudinal rail are separately secured to the first end of the first cross rail and the first end of the second cross rail;

a second longitudinal rail including a top portion having a row of fourth sockets in a line along an axial direction, wherein both ends of said second longitudinal rail are separately secured to the second end of the first cross rail and the second end of the second cross rail;

one or more cross steel wires, both ends of which are hooks, a first end hook of each cross steel wire encloses a part of the top portion of the first longitudinal rail, and is secured by being directly inserted into one of the third sockets at the top portion of the first longitudinal rail, a second end hook of each cross steel wire encloses a part of the top portion of the second longitudinal rail, and is secured by being directly inserted into one of the fourth sockets at the top portion of the second longitudinal rail; and wherein the first longitudinal rail and the second longitudinal rail tense the steel wires to form a steel wire netting.

* * * * *